US005435101A

United States Patent [19]

Garries

[11] Patent Number: 5,435,101

[45] Date of Patent: Jul. 25, 1995

[54] OPERATING MECHANISM FOR SLIDING WINDOW AND DOOR SASHES

[75] Inventor: Ray Garries, Springboro, Ohio

[73] Assignee: Aluminum Company of America, Pittsburgh, Pa.

[21] Appl. No.: 201,446

[22] Filed: Feb. 24, 1994

[51] Int. Cl.[6] ..... E05F 11/00

[52] U.S. Cl. ..... 49/361

[58] Field of Search ..... 49/25, 29, 31, 139, 49/176, 177, 360, 361, 199, 200, 362

[56] References Cited

U.S. PATENT DOCUMENTS

| | | | |
|---|---|---|---|
| 594,553 | 11/1897 | Pearson | 49/361 |
| 670,929 | 4/1901 | Feder | 49/361 |
| 1,152,425 | 9/1915 | Lovell . | |
| 1,870,992 | 8/1932 | Freuler | 49/29 X |
| 1,966,815 | 7/1934 | Fuller . | |
| 2,321,591 | 6/1943 | Gardner | 49/29 X |
| 2,359,518 | 10/1944 | Graham | 49/361 |
| 2,545,449 | 3/1951 | Curley . | |
| 2,913,920 | 11/1959 | Wise . | |
| 3,022,065 | 2/1962 | Martin . | |
| 3,469,345 | 9/1969 | Hanks | 49/31 X |
| 4,628,636 | 12/1986 | Folger | 49/199 |
| 5,301,734 | 4/1994 | Opel | 49/361 |

FOREIGN PATENT DOCUMENTS

| | | | |
|---|---|---|---|
| 397179 | 11/1990 | European Pat. Off. | 49/31 |
| 832 | 1/1891 | United Kingdom | 49/361 |

*Primary Examiner*—Jerry Redman

*Attorney, Agent, or Firm*—Glenn E. Klepac

[57] ABSTRACT

An operating mechanism for sliding a sash of a window or door. The mechanism includes an open spiral having a hollow, longitudinally extending center; rotator for rotating the open spiral around its center; and coupling element for coupling the open spiral to a window or door sash. A preferred window made with the operating mechanism of the invention includes extruded polymeric window jambs housing two open spirals on opposed lateral sides of a sash. The preferred window includes both a hand crank and an electric motor connected by a series of gears and a rod to the open spirals.

19 Claims, 6 Drawing Sheets

OPERATING MECHANISM FOR SLIDING WINDOW AND DOOR SASHES

FIELD OF THE INVENTION

This invention relates to an operating mechanism for a slidably mounted door or window, and more particularly to an operating mechanism that can be used to facilitate opening and closing such a slidably mounted door or window.

BACKGROUND OF THE INVENTION

Slidably mounted building products, such as sliding windows, single hung and double hung windows and sliding doors, are well known in the new construction and remodeling industry. These products are typically operated by a user exerting a sliding-type force on the movable sash in order to open or close the same. As will be appreciated, the amount of force that needs to be exerted can at times be substantial, and thus physically handicapped persons or those persons with inadequate strength may not be able to operate them.

Furthermore, with the advent of so-called "smart homes" it is desired to be able to control electronically or by computer the opening and closing of windows and doors, without the need for a person to be present to open and close the same. Currently existing windows and doors with sliding sashes would be extremely difficult to convert to automatic operation.

In the first half of the 20th century, several patents were issued which disclosed crank type window operating apparatus for slidably mounted windows. For example, Lovell U.S. Pat. No. 1,152,425 shows a double hung window which can be moved up and down by use of a hand crank. The hand crank turns a bevel gear connected to a left-hand rod and a right-hand rod, the rods turning another bevel gear which in turn rotates a longitudinally disposed screw mounted in each of the vertical window frame members. A movable nut is threadably mounted on each screw and is also secured to the window sash. Rotation of the screws causes vertical movement of the movable nuts, which in turn lowers or lifts the window sash in the window frame. See also U.S. Pat. Nos. 1,571,819; 1,966,815; 2,545,449; 2,913,920; and 3,022,065.

Although this prior art has been known for many years, there are today virtually no commercially available slidably mounted doors and windows which are operated by hand crank or motor driven mechanisms. There is, therefore, a need for a modern operating mechanism for slidably mounted building products that is inexpensive as well as easy to use. The mechanism must be useful for windows and doors having wood, metal or polymeric frames and must be reliable and easy to install in both new and existing homes.

SUMMARY OF THE INVENTION

The foregoing objectives of the invention are accomplished by providing a novel operating mechanism for sliding sash windows and doors. The operating mechanism includes at least one open spiral having an open center or center area, rotator means for rotating the open spiral around its center, and coupling means for coupling the open spiral to a sash. The operating mechanism is suitable for use with both single hung and double hung windows having vertically sliding sashes, windows having horizontally sliding sashes and doors including horizontally sliding sashes such as patio doors.

The operating mechanism preferably includes two open spirals located on opposite sides of the sliding sash. A particularly preferred upright window having a sash sliding upwardly and downwardly includes open spirals on left and right sides of the sliding sash.

Open spirals of the invention are preferably elongated metal strips wound into a helical shape around a longitudinally extending center axis. Steel strips having generally rectangular transverse cross sections are particularly preferred. Windings in the preferred spirals define a longitudinally extending succession of substantially equal open spaces between adjacent windings.

The rotator means of the invention powers the open spirals so that they can slide the sash. The rotator means may be a manually operated crank, an electric motor, or combinations thereof. A particularly preferred operating mechanism includes both an electric motor and a hand crank.

A window or door made in accordance with the invention includes a frame, a first open spiral, rotator means for rotating the first open spiral, a slidable sash attached to the frame, and coupling means for coupling the sash to the first open spiral.

The frame preferably includes a longitudinally extending first member, a second member generally parallel to the first member, and additional frame members connecting the first and second members. In a particularly preferred double hung window oriented in an upright position, the first and second members are generally vertically extending jambs and the additional frame members are a generally horizontal sill and generally horizontal header extending between the jambs. The jambs, sill and header combine to define a generally rectangular window or door opening.

In a particularly preferred embodiment, the frame members are all extruded polymeric lineals. The first and second frame members each define an internal cavity. The sill comprises a floor, a sill cover and side walls defining a gear box containing the rotator means and gear means for transmitting power from the rotator means to the spirals. Open spirals are housed within the internal cavities of the first and second frame members and are journalled into bearings at their upper and lower ends.

A gear means transmits power from the rotator means to the open spirals. A preferred first gear means connected to the first open spiral comprises a first bevel gear connected to the rotator means; a second bevel gear connected to the first bevel gear; a rod connected to the second bevel gear; a third bevel gear connected to the first rod, lateral of the second bevel gear; and a fourth bevel gear connecting the third bevel gear and the open spiral. Similarly, a preferred gear means in an assembly having two open spirals also includes a fifth bevel gear attached to the rod and a sixth bevel gear connecting the fifth bevel gear to the second open spiral. In this preferred embodiment, power is transmitted synchronously from the rotator means to both open spirals.

In a preferred assembly, the first and second frame members are extruded polymeric lineals, preferably vinyl (polyvinyl chloride) lineals. The first and second frame members each define an internal recess or cavity having a generally rectangular horizontal cross section. The open spirals are smaller than the recesses in which they are situated. In order to reduce sideways wobbling or vibration of the open spirals, the recesses are each provided with at least one longitudinally extending spline or adapter having an external portion attached to the frame member and an internal portion adjacent an open spiral.

BRIEF DESCRIPTION OF THE DRAWINGS

A more full understanding of the invention can be gained from the following description of the preferred embodiments when read in conjunction with the accompanying drawings in which.

DETAILED DESCRIPTION

Figure 1:
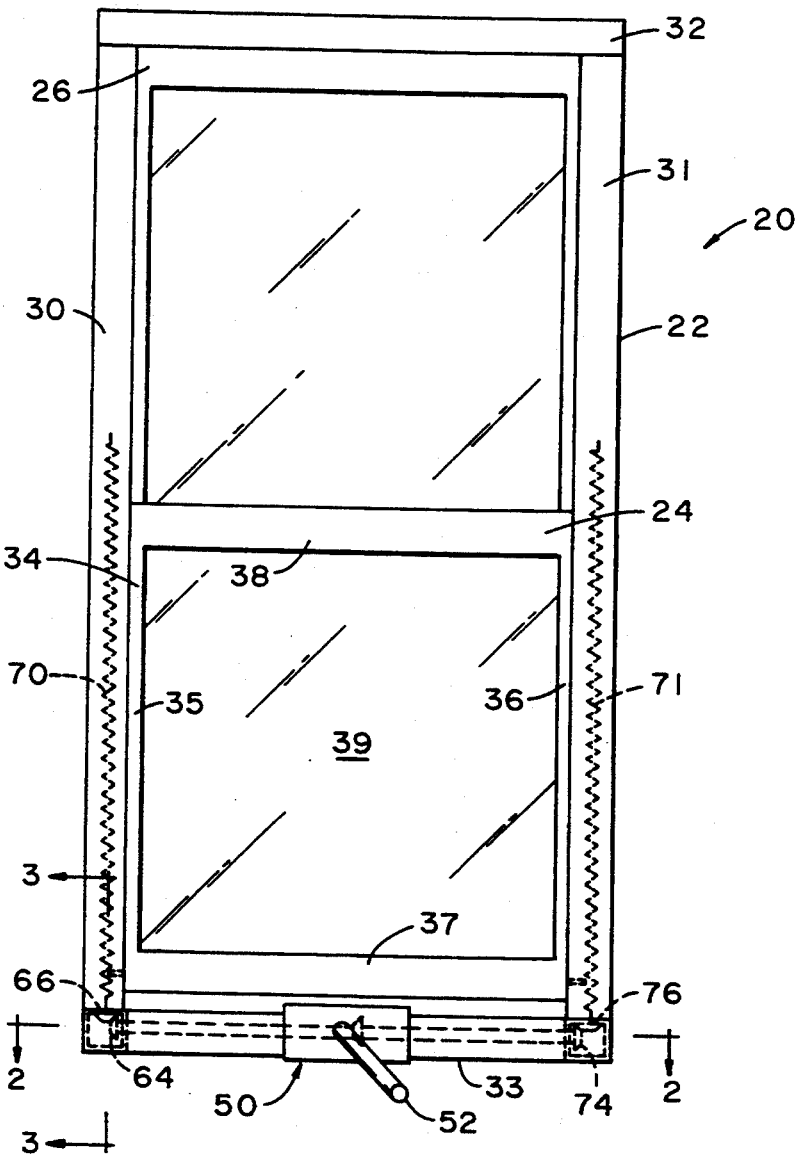
FIG. 1 is front elevational view of a single hung window embodying the invention.

Referring now to FIG. 1, a standard single hung window 20 is shown. The single hung window 20 includes a window frame 22 in which a lower window sash 24 is slidably mounted. An upper window sash 26 is fixed to the frame 22.

The window frame 22 further includes two vertical side jambs 30, 31, a header 32 and a sill 33 which are joined by conventional methods to form the rectangular window frame 22 defining a rectangular opening. Frame members 30, 31, 32, 33 are shown in FIG. 1 as being composed of a polymeric material, preferably vinyl. It will be appreciated that these frame members can be made of extruded aluminum or wood or combinations of aluminum, vinyl and wood, such as vinyl clad aluminum.

The window sashes 24 and 26 are of similar construction, so that only window sash 24 is described herein. Window sash 24 comprises a window sash frame 34 including two vertical stiles 35, 36, a lower rail 37 and an upper rail 38, all of which are joined together at their end portions. A panel of glass 39 is mounted in the window sash frame 34. As with the window frame members, the window sash members are shown in FIG. 1 as being made of extruded vinyl lineals, although it will be appreciated that the sash members can also be made of aluminum or wood or combinations of aluminum, wood and vinyl.

An embodiment of the operating mechanism 50 of the invention is shown in FIGS. 1–5. Operating mechanism 50 comprises a hand crank 52 which is secured to one end of a rotatable shaft 54, the other end of the rotatable shaft 54 having mounted thereon a first bevel gear 56.

The first bevel gear 56 operationally engages a second bevel gear 58 wherein rotating the hand crank 52 also rotates the second gear 58. The second bevel gear 58 is secured to a first rod 60 extending laterally across the gear box 61 between the jambs 30, 31. The rod 60 is supported by bearings *62a, 62b, 62c, 62d* attached to a wall of the gear box 61.

Figure 5:
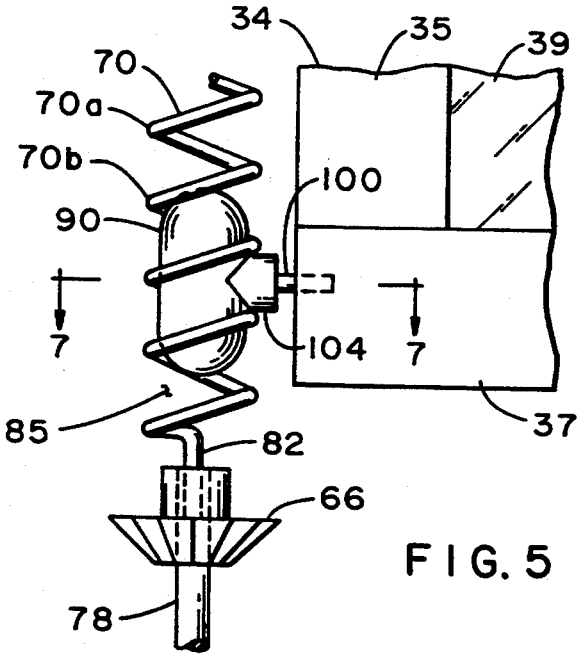
FIG. 5 is a front elevational view of FIG. 4.
Figure 3:
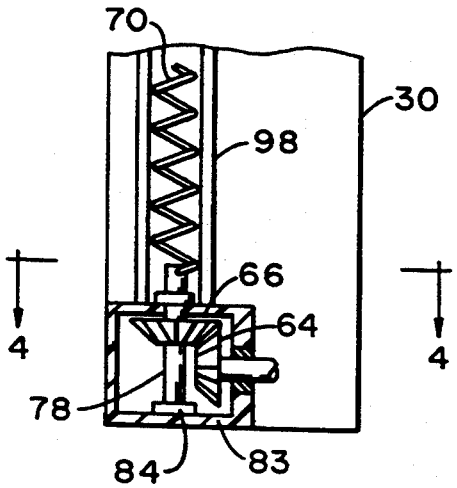
FIG. 3 is a cross-sectional view taken along line 3—3 of FIG. 1.

A third bevel gear 64 is connected to an end of the rod 60, spaced laterally from the first and second gears 56, 58. The third bevel gear 64 meshes with a fourth bevel gear 66 connected to a first open spiral 70 extending longitudinally through a side jamb 30. In the preferred window shown herein, a second open spiral 71 also extends longitudinally through the other side jamb 31. A fifth bevel gear 74 is secured to an end of the rod 60 opposite the third bevel gear 64. The fifth bevel gear 74 meshes with a sixth bevel gear 76 connected to a lower end portion of the second open spiral 71. As shown in FIGS. 3 and 5, the fourth bevel gear 66 is mounted on a rotatable shaft 78. A lower end 82 of the first spiral 70 is connected to the shaft 78. The fifth and sixth bevel gears 74, 76 are connected in an identical manner to the second spiral 71. It will be appreciated that rotation of the crank 52 will rotate the first bevel gear 56, with power in the turn being transmitted through the second gear 58 to the rod 60. The rod 60 then turns the third gear 64 and fifth gear 74, which rotate the fourth gear 66 and sixth gear 76, respectively. The fourth gear 66 rotates the first spiral 70, and the sixth gear 76 rotates the second spiral 71. Thus, manual rotation in the hand crank 52 is transmitted through the gear means into simultaneous rotation of the spirals 70, 71.

As shown in FIG. 3, the third gear 64 and fourth gear 66 are provided as a unit, inside a bearing box 83. The shaft 78 is journalled into a bearing 84 supported by the bearing box 83. An identical bearing box (not shown in FIG. 3) containing the fifth and sixth gears 74, 76 is also provided below the second spiral 71.

Referring again to FIG. 2, the rod 60 extends between the third gear 64 and the fifth gear 74. The third gear 64 defines a square opening 60' (see FIG. 10) to facilitate engagement with the square rod 60. The fifth gear 74 also defines an identical square opening (not shown) for connection with the square rod 60.

An advantage of the bearing boxes 63 provided herein is that the rod 60 may be cut to any desired length at a construction site. Accordingly, windows and doors provided with the operating mechanism of the invention are easily retrofitted to fill existing openings of arbitrary size in building walls. Greater flexibility is thereby provided, compared with most prior art windows and doors.

Figure 4:
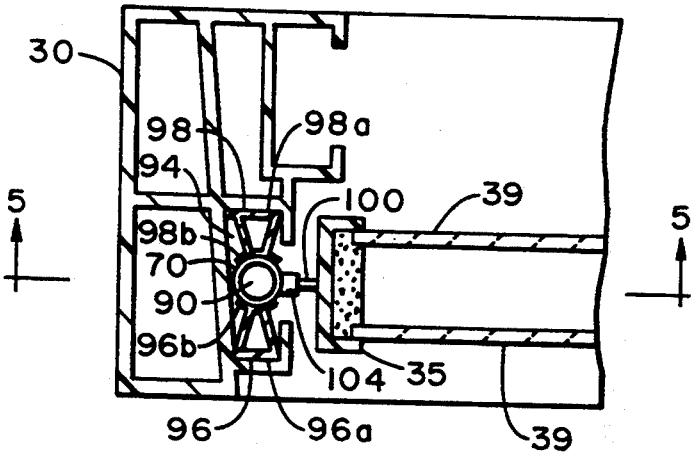
FIG. 4 is a cross-sectional view taken along line 4—4 of FIG. 3.

As shown in FIGS. 3, 4 and 5, the first open spiral 70 comprises an elongated, helically wound steel strip having a hollow center or center area 85. The spiral 70 includes longitudinally extending loops or coils *70a, 70b* having open space between them. Open spirals 70, 71 of the present invention are lighter in weight than solid screws of the prior art, and they readily accommodate nylon lift blocks 90, 91 in their hollow centers 85. The lift blocks 90, 91 provide a convenient means for coupling the open spirals 70, 71 to the sash frame 34, as described in greater detail below.

In the preferred embodiment described herein, the vertical jambs 30, 31 are extruded hollow vinyl lineals. As shown in FIG. 4, the first jamb 30 defines a generally rectangular internal recess 94 containing the first spiral 70. In order to limit sideways movement of the spiral 70 within its recess 94, two elongated splines or adapters 96, 98 of polymeric material are inserted in the recess 94, extending generally parallel to the spiral 70. Each spline 96, 98 includes an external portion **96*a*, 98*a* attached to the jamb 30 and an internal portion 96*b*, 98*b* adjacent the spiral 70. The internal portions 96*b*, 98*b* have a curvature complementary to that of the spiral 70**.

Figure 7:
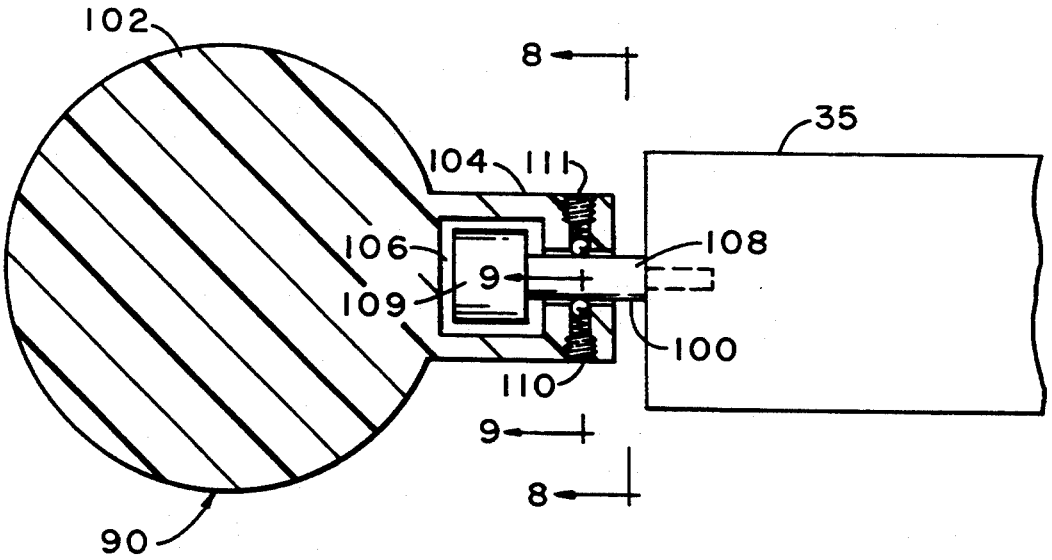
FIG. 7 is a cross-sectional view taken along the line 7—7 of FIG. 5.
Figure 8:
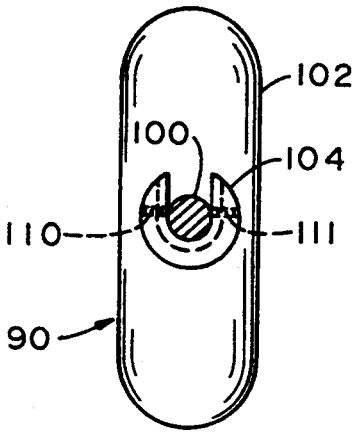
FIG. 8 is a cross-sectional view taken along the line 8—8 of FIG. 7.
Figure 9:
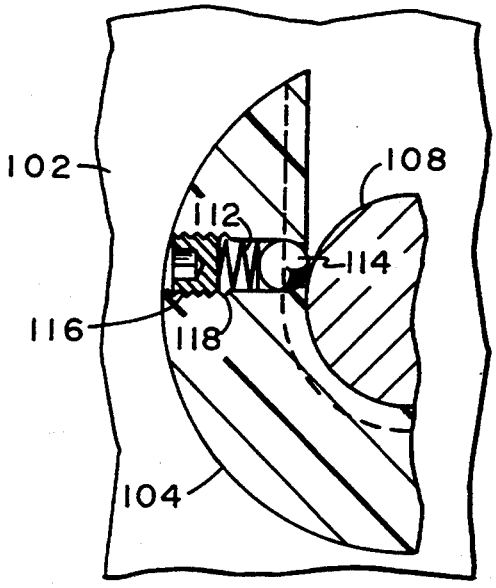
FIG. 9 is a cross-sectional view taken along line 9—9 of FIG. 7.

Referring now to FIGS. 7, 8 and 9, there is shown a particularly preferred coupling means for connecting the spirals 70, 71 to a slidable window sash frame 34. The coupling means includes a nylon lift block 90 and a pivot bar 100 attached to the sash frame 34. The lift block 90 includes a principal portion 102 in the spiral center area 85 and an arm 104 extending laterally from the spiral 70. The arm 104 defines an opening 106 extending laterally outward of the spiral 70. The pivot bar 100 comprises a bar 108 attached to a stile 35 of the sash frame 34 and a boss 109 inserted in the opening 106.

As shown in FIGS. 7 and 8, a pair of detent means or detents 110, 111 retains the bar 108 in the opening 106. The detent 110 shown in FIG. 9 includes a spring 112, a steel ball 114 having a portion maintained in the opening 106 by the spring 112, and a set screw 116 adjacent the spring 112 for maintaining the spring 112 and ball 114 in place within an orifice 118 in the arm 104.

The detents 110, 111 each include steel balls 114 which extend into and narrow the openings 106, thereby preventing the pivot bars 100 from slipping out of the openings 106. The window sash 24 may be pivoted inwardly about the pivot bars 100 to facilitate cleaning an exterior surface portion of the glass window pane 39. If it is desired to remove the window sash 24, for example to replace a broken glass pane 39, the sash frame is elevated to its highest position by rotating the spirals 70, 71. Then, the sash 24 is lifted forcibly upward to flex the springs 112 and move the steel balls 114 outwardly from the pivot bars 100, thereby widening the openings 106 sufficiently to allow passage of the pivot bars 100 past the detents 110, 111. The sash 24 is replaced by forcing the pivot bars 100 downwardly with sufficient force to flex the springs 112, thereby to move the steel balls 114 outwardly and to widen the openings 106 so that the pivot bars 100 can slide past the detents 110, 111.

Figure 6:
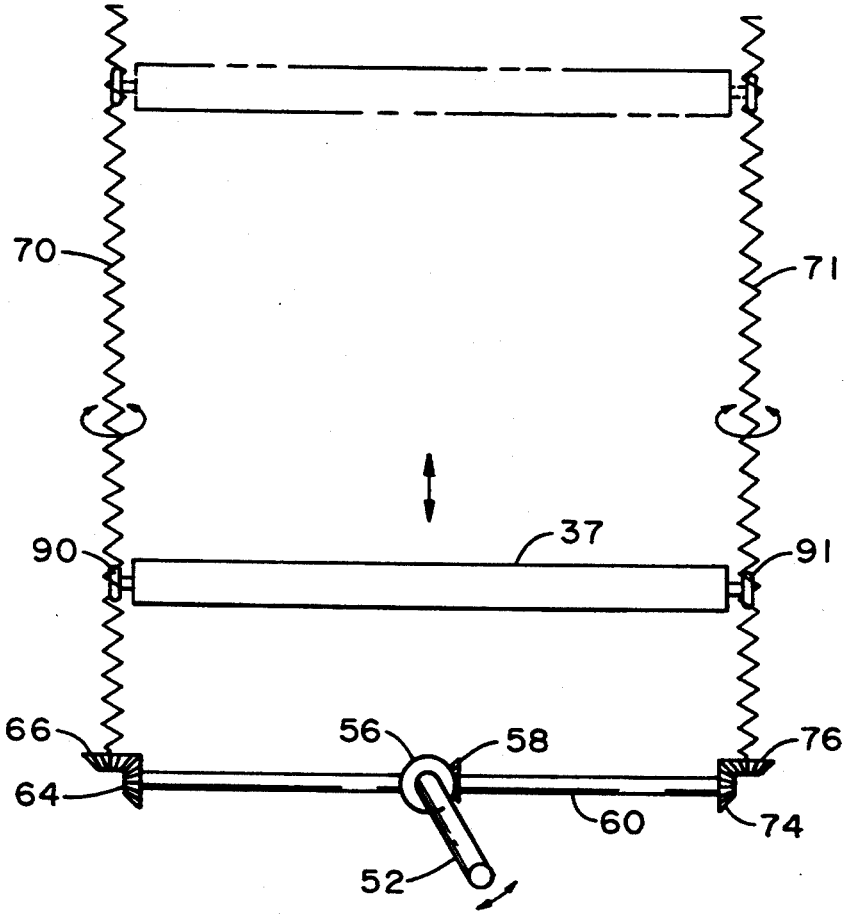
FIG. 6 is a schematic, fragmentary front elevational view of the window of FIG. 1.

Operation of a typical window assembly 120 of the invention is shown schematically in FIG. 6. Rotation of the hand crank 52 is transmitted through bevel gears 56, 58 to the rod 60 and then to bevel gears 64, 66, 74, 76. The fourth bevel gear 66 and sixth bevel gear 76 are connected to spirals 70, 71. Rotation of the spirals 70, 71 elevates the lift blocks 90, 91 which are connected to a lower rail 37 of the sash frame 34. Conversely, rotation of the hand crank 52 will also lower the lift blocks 90, 91 and sash frame 34.

Figure 2:
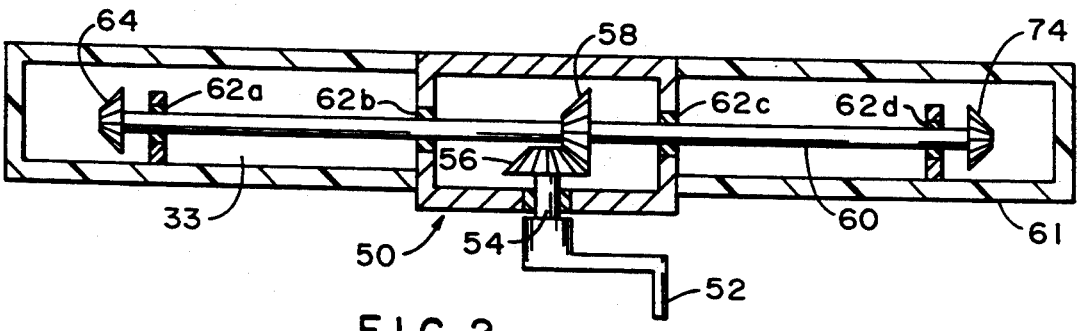
FIG. 2 is a cross-sectional view taken along line 2—2 of FIG. 1.

In the preferred embodiment shown in FIGS. 1, 2 and 6, the open spirals 70, 71 rotate in opposite directions when the hand crank 52 is turned. Accordingly, the spirals 70, 71 are pitched in opposite directions to assure that the lift blocks 90, 91 are elevated and lowered together when power is transmitted from the hand crank 52 to the spirals 70, 71.

Figure 10:
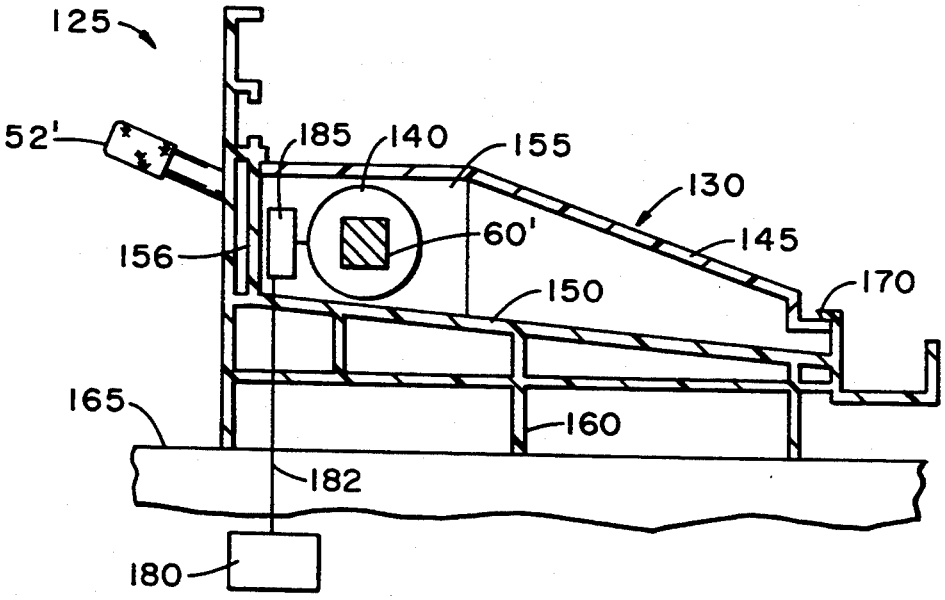
FIG. 10 is a schematic, fragmentary cross-sectional view of an alternative embodiment of a window embodying the present invention.

There is shown in FIG. 10 an alternative embodiment of the operating mechanism 125 of the present invention housed within a modified gear box 130. The operating mechanism 125 includes both a hand crank 52 extending outside the box 130 and an electrically operated tube motor 140 housed within the box 130. The hand crank 52 and motor 140 provide alternative power sources which may be connected to the rod 60 at different times.

The gear box 130 shown in FIG. 10 includes a removable lid or cover 145, a bottom wall or floor 150 and side walls 155, 156. Several legs 160 extend downwardly from the bottom wall 150, thereby supporting the floor 150 above a window ledge 165. Disposition of the bottom wall 150 above the ledge 165 is desirable for preventing any accumulation of moisture, thereby prolonging useful life of the motor 140. The lid 145 may be removed by outwardly flexing a tab 170 retaining the lid 145 in its position. Removal of the lid 145 permits access to the electric motor 140 and other contents of the box 130 for repair or replacement.

The motorized operating mechanism described above will facilitate opening and closing of window sashes in the so-called "home of the future". The "home of the future" or "smart house" concept involves computer control of the home environment, including its heating and cooling systems. For example, windows can be automatically opened or closed at appropriate times to supply desired ventilation in order to save on energy costs.

The motorized or automatic window can also be used with switches that allow remote operation. A remote switch can be used, for example, by persons who do not have enough strength to lift an upwardly-slidable window sash. Other features that can be added to the motorized window are rain and security actuators. A rain actuator can consist of a decal or patch mounted on the outside sill of a window. When rain contacts the decal, a circuit is formed, which in turn activates the motorized window to close. In this way, windows close automatically when rain begins to fall.

A security activator operates similarly in that motion detectors can sense when an intruder is near or attempts to enter a house. The security activator can be tied into the home security system by closing all windows if motion is detected anywhere nearby.

The foregoing objectives are accomplished with the operating mechanism 125 shown schematically in FIG. 10. An electric signal generator 180 comprising either a timer, motion detector or rain sensor is connected by a wire 182 to an activator 185 associated with the motor 140. The signal generator 180 emits an electric signal in response to a circuit formed in the time, motion detector or rain sensor. This signal is carried through the wire 182 to the activator 185 and motor 140. Accordingly, a window sash (not shown) connected with the motor 140 is either opened or closed, depending upon the signal emitted by the generator 180.

Figure 11:
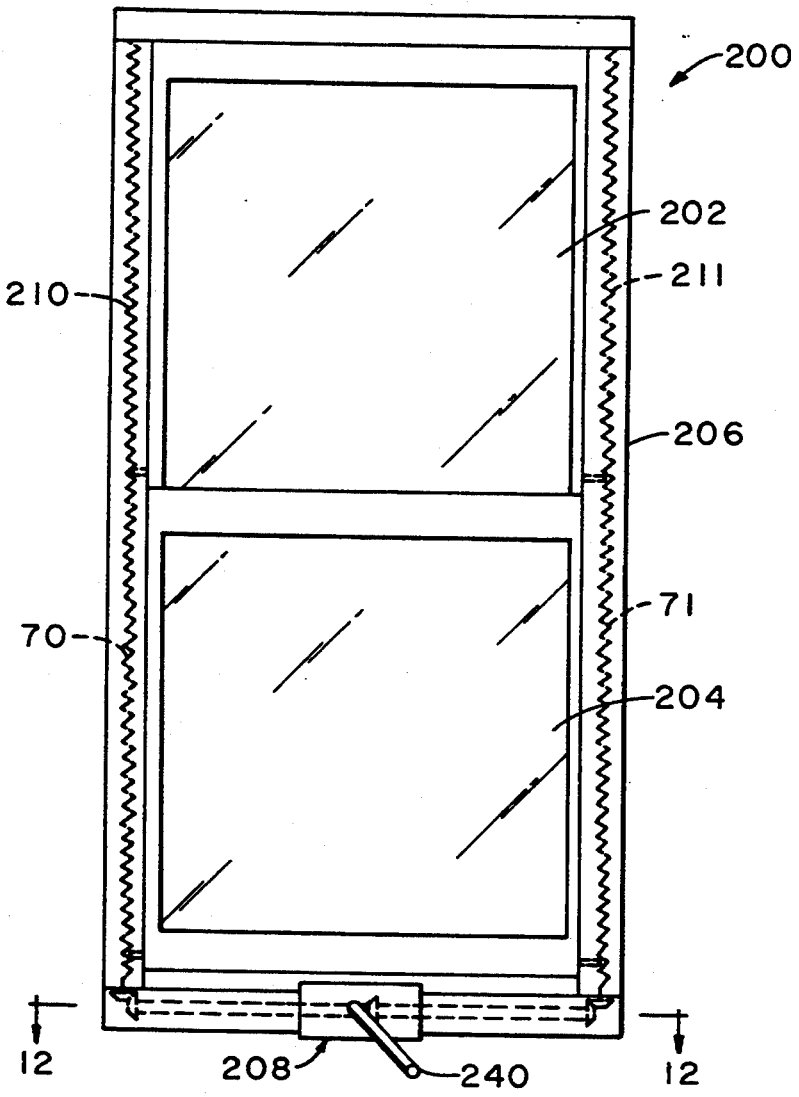
FIG. 11 is a front elevational view of a double hung window embodying the invention.

Referring now to FIG. 11, a double hung window 200 is shown in which both an upper sash 202 and a lower sash 204 are slidable in a window frame 206, using an alternative operating mechanism 208. The sashes 202, 204 and window frame 206 are constructed similarly to and made from the same materials as the window sashes and window frames shown in FIGS. 1–5 and 7–9 except for the provision of a pair of additional open spirals 210, 211 which are operatively engaged with the upper sash 202.

Figure 12:
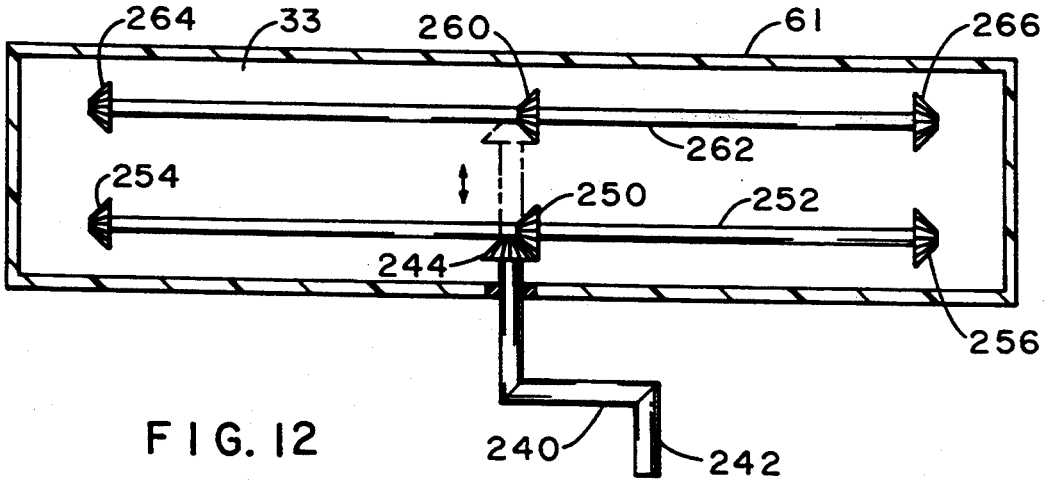
FIG. 12 is a cross-sectional view taken along the line 12—12 of FIG. 11.

Referring now to FIG. 12, the operating mechanism 208 includes a reciprocating hand crank 240 having a handle end 242 and a bevel gear engagement end 244 opposite the handle end 242. The bevel gear engagement end 244 has gear teeth 246 on its outer circumferential surface which are complementary to teeth on a bevel gear 250 attached to a first rod 252. Rotating the crank 240 when it is in this first position transmits power through the first rod 252 to bevel gears 254, 256 at opposed ends of the rod 252 and then to the open spirals 70, 71 associated with the lower sash 204. The lower sash 204 is thereby raised or lowered in response to rotation of the crank 240.

When it is desired to move the upper sash 202 in the window frame 206, the bevel gear engagement end 244 is pushed out of engagement with the bevel gear 250 attached to the first rod 252 and into engagement with another bevel gear 260 attached to a second rod 262. Rotating the crank 240 in this second position transmits power through the second rod 262 to bevel gears 264, 266 at opposed ends of the rod 262 and then to upper open spirals 210, 211 associated with the upper sash 202. The upper sash 202 is thereby raised or lowered in response to rotation of the crank 240.

Figure 13:
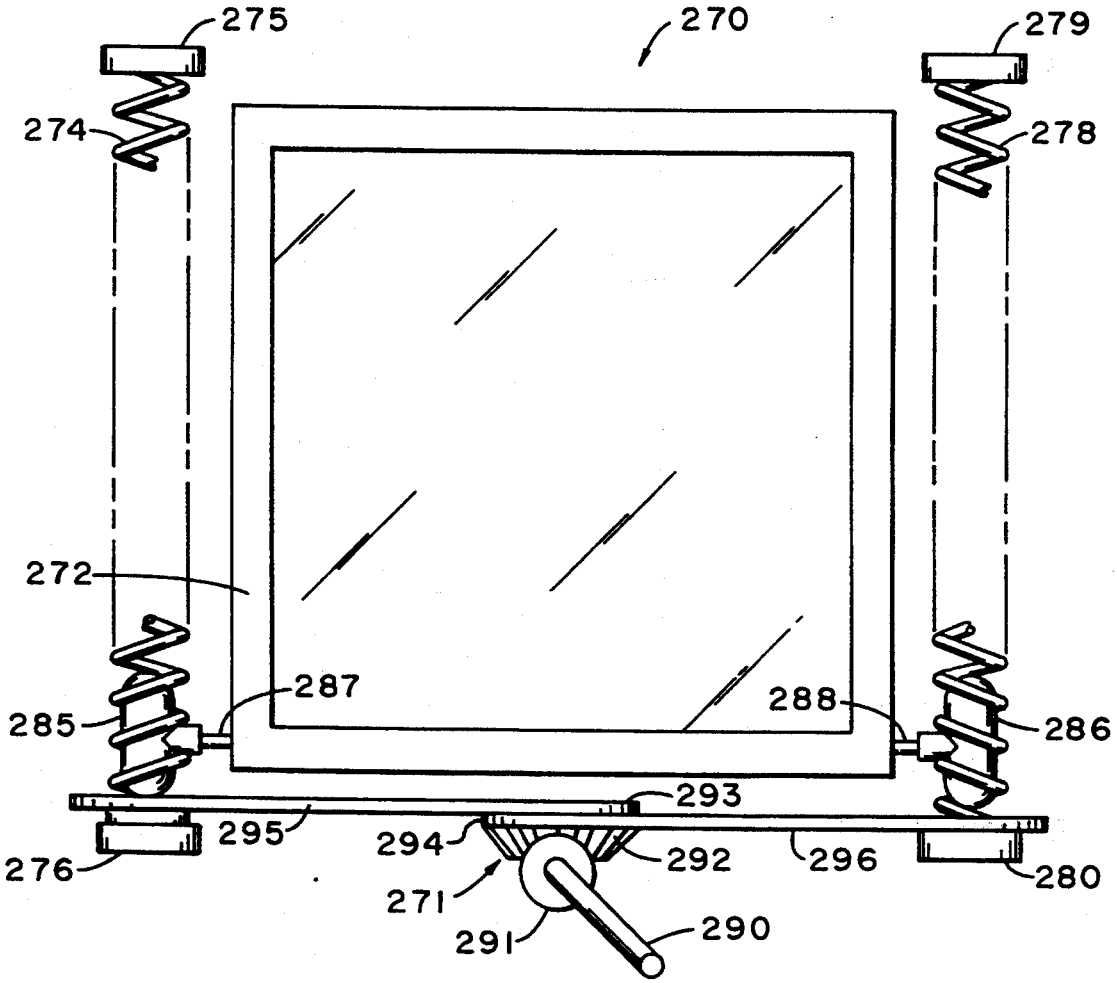
FIG. 13 is a schematic front elevational view of an alternative embodiment of a window made in accordance with the present invention.

An alternative window assembly 270 including an operating mechanism 271 of the invention is shown in FIG. 13. The window assembly 270 includes a window sash 272, a first open spiral 274 supported between an upper bearing 275 and a lower bearing 276 and a second open spiral 278 supported between an upper bearing 279 and a lower bearing 280. The first open spiral 274 engages a first lift block 285, and the second open spiral 278 engages a second lift block 286. Pivot bars 287, 288 extending from the lift blocks 285, 286 connect the open spirals 274, 278 with the sash 272, all as described above.

The alternative operating mechanism 271 of FIG. 13 includes a hand crank 290 attached to a first bevel gear 291. The first bevel gear 291 engages a second bevel gear 292 associated with belt sprockets 293, 294. A first flexible belt or timing belt 295 extends between the first belt sprocket 293 and the lower bearing 276 connected with the first open spiral 274. A second flexible belt 297 extends between the second belt sprocket 294 and the lower bearing 280 connected with the second open spiral 278.

Rotating the hand crank 291 causes rotation in the first bevel gear 292 and belt sprockets 293, 294. Power is then transmitted through the two belts 295, 296 to lower beatings 276, 280 connected with the open spirals 274, 278. Rotating the open spirals 274, 278 in turn elevates the lift blocks 285, 286, thereby raising the window sash 272. It will be appreciated that rotating the crank 291 in an opposite direction lowers the sash 272.

Numerous changes and modifications may be included in the particularly preferred embodiments described above without departing from the spirit of the invention. For example, the double hung window assembly of FIGS. 11 and 12 may contain only two open spirals rather than four. In this alternative embodiment, each open spiral includes coils pitched in a first direction adjacent the lower sash and pitched in an opposite direction adjacent the upper sash. For example, a lower portion of the left spiral may have a left-hand pitch and an upper portion of that spiral may have a right-hand pitch. In the right spiral, a lower portion adjacent the lower sash will have a right-hand pitch and an upper portion adjacent the upper sash will have a left-hand pitch. Rotating the open spirals will thereby lower the upper sash when the lower sash is raised to an open position. Similarly, the spirals will lower the lower sash toward a closed position when the upper sash is elevated toward its closed position.

It is therefore seen that this invention provides an operating mechanism that is operatively associated with a window or door sash slidably mounted in a frame. While some alternative modes for practicing the invention have been described, the appended claims are intended to cover all modes and embodiments which fall within the spirit of the invention.

What is claimed is:

1. An operating mechanism for sliding a window or door sash comprising:

(a) an open spiral sized for confinement within a frame member, said open spiral having a hollow, longitudinally extending open center;

(b) rotator means for rotating said open spiral around said open center; and (c) coupling means for coupling said open spiral to a window or door sash, said sash sliding longitudinally in response to rotation of said open spiral, said coupling means comprising:

(i) a lift block disposed in said center and an arm extending outside said center, said arm defining an opening extending outward of said open spiral; and (ii) a pivot bar including a boss inserted in said opening and a bar extending outward thereof.

2. The mechanism of claim 1 wherein said open spiral comprises an elongated, generally helical metal strip.

3. The mechanism of claim 1 wherein said open spiral includes a plurality of loops having a longitudinally extending succession of open spaces between adjacent loops.

4. The mechanism of claim 1 wherein said open spiral comprises a steel strip.

5. The mechanism of claim 1 wherein said rotator means comprises at least one of a manually rotatable crank and an electric motor.

6. A window or door having a sliding sash and comprising:

(a) a frame comprising a longitudinally extending first member and a second member generally parallel to said first member;

(b) a first open spiral associated with said first member, said first open spiral having a longitudinally extending hollow center;

(c) rotator means for rotating said first open spiral around said hollow center;

(d) a slidable window or door sash attached to said frame; and (e) first coupling means for connecting said sash to said first open spiral, said sash sliding longitudinally responsive to rotation by said first open spiral, said first coupling means comprising:

(i) a lift block disposed in said center and an arm extending outside said center, said arm defining an opening extending outward of said first open spiral; and (ii) a pivot bar including a bar attached to said sash and a boss inserted in said opening, said sash being pivotable about said pivot bar to facilitate cleaning said sash.

7. The window or door of claim 6 further comprising:

(f) first gear means for converting rotation by said rotator means into rotation by said first open spiral.

8. The window or door of claim 7 wherein said first gear means comprises:

(i) a first bevel gear connected to said rotator means;

(ii) a second bevel gear connected to said first bevel gear;

(iii) a first rod connected to said second bevel gear and extending laterally thereof;

(iv) a third bevel gear connected to said first rod laterally of said second bevel gear; and (v) a fourth bevel gear connecting said third bevel gear and said open spiral whereby rotation by said rotator means rotates said first open spiral.

9. The window or door of claim 6 further comprising:

(f') a second open spiral associated with said second member, said second open spiral having a longitudinally extending hollow center; and (g') second coupling means for coupling said sash to said second open spiral, and wherein said rotator means includes means for rotating said second open spiral around its hollow center.

10. The window or door of claim 9 further comprising:

(h') second gear means for converting rotation by said rotator means into rotation by said second open spiral.

11. The window or door of claim 6 wherein said first member defines an internal recess containing said first open spiral and further comprising:

(i') a spline in said recess for limiting movement of said first open spiral, said spline comprising an external portion attached to said first member and an internal portion adjacent said first open spiral.

12. The window or door of claim 11 wherein said first member comprises an extruded polymeric lineal.

13. The window or door of claim 6 wherein said first coupling means further comprises:

(iii) detent means for releasably detaining said pivot bar in said lift block opening.

14. A sliding sash window comprising:

(a) a frame comprising generally vertical first and second jambs connected to a sill and a header;

(b) first and second open spirals confined within respective said first and second jambs, each said open spirals comprising a helically wound metal strip surrounding a hollow, vertically extending center area;

(c) a window sash connected to said frame;

(d) coupling means connecting said sash to said open spirals, said window sash sliding upwardly or downwardly responsive to rotation by said open spirals, said coupling means comprising first and second lift blocks each having a portion disposed in said center area and an arm extending outward thereof, said arm being connected to a pivot bar attached to said window sash;

(e) rotator means for rotating said first and second open spirals around their center areas, said rotator means being selected from the group consisting of a hand crank, an electric motor and combinations thereof; and (f) gear means for transmitting power from said rotator means to said first and second open spirals.

15. The window of claim 14 wherein said rotator means comprises an electric motor and further comprising:

(g) a timer, motion detector or rain sensor connected with said electric motor; and (h) an activator for activating said electric motor in response to a signal from said timer, motion detector or rain sensor.

16. The window of claim 14 wherein said sill comprises:

(i) a floor, a sill cover and side walls defining a box containing said rotator means and said gear means; and (ii) at least one leg for elevating said box above a ledge, said leg extending downwardly from said floor.

17. The window of claim 16 wherein said floor and said sill cover each comprise a polymeric extrusion.

18. An apparatus for opening and closing a window or door having at least one sash supported in a frame, said apparatus comprising:

(a) at least two spirals disposed laterally of said sash, each said spirals comprising spaced apart coils surrounding an open center;

(b) coupling means comprising at least two lift blocks slidably disposed in the open center of said spirals and an arm extending outside said center and a pivot bar connecting said arm with said sash; and (c) means for rotating each said spirals, thereby to slide said coupling means longitudinally and to move said sash in its frame.

19. The apparatus of claim 18 wherein said open spiral comprises an elongated, generally helical steel strip including a plurality of loops and a succession of open spaces between adjacent loops.

* * * * *